US006368376B2

(12) United States Patent
Hong et al.

(10) Patent No.: US 6,368,376 B2
(45) Date of Patent: Apr. 9, 2002

(54) PROCESS FOR MAKING OXIDE DISPERSION-STRENGTHENED TUNGSTEN HEAVY ALLOY BY MECHANICAL ALLOYING

(75) Inventors: Soon Hyung Hong; Ho Jin Ryu, both of Taejon Kwangyeok-si (KR)

(73) Assignee: Korea Advanced Institute of Science and Technology, Kwangyeok-Si (KR)

( * ) Notice: Subject to any disclaimer, the term of this patent is extended or adjusted under 35 U.S.C. 154(b) by 0 days.

(21) Appl. No.: 09/734,174

(22) Filed: Dec. 12, 2000

(30) Foreign Application Priority Data

Jul. 8, 2000 (KR) ..... 12-39100

(51) Int. Cl.[7] ..... B22F 1/00; C22C 1/05; C22C 27/04

(52) U.S. Cl. ..... 75/235; 75/248; 419/20; 419/23; 419/29; 419/32; 419/38; 419/57

(58) Field of Search ..... 419/20, 23, 32, 419/46, 29, 54, 58, 38, 57; 75/235, 248; 420/430

(56) References Cited

U.S. PATENT DOCUMENTS 4,762,559 A * 8/1988 Penrice et al. ..... 75/248
4,923,673 A * 5/1990 Litty ..... 419/20
4,950,327 A * 8/1990 Eck et al. ..... 75/232
4,986,961 A * 1/1991 Spencer et al. ..... 419/36
5,590,392 A * 12/1996 Ishiwata et al. ..... 428/546
5,603,073 A * 2/1997 Bose ..... 419/57
5,868,876 A * 2/1999 Bianco et al. ..... 148/407
6,136,105 A * 10/2000 Spencer ..... 148/514

OTHER PUBLICATIONS

ASM Handbook, vol. 7, Powder Metallurgy, pp. 710–727, Jun. 1984.*

* cited by examiner

*Primary Examiner*—Daniel J. Jenkins
(74) *Attorney, Agent, or Firm*—Rosenberg, Klein & Lee

(57) ABSTRACT

Disclosed is a process for making an oxide dispersion-strengthened tungsten heavy alloy by mechanical alloying that includes the steps of: adding 0.1 to 5 wt. % of $Y_2O_3$ powder to a mixed powder comprising more than 90 wt. % of tungsten powder, and nickel and iron powders for the rest; and subjecting the resulting mixture to a mechanical alloying to prepare an oxide dispersion-strengthened tungsten heavy alloy powder. The oxide dispersion-strengthened tungsten heavy alloy prepared by the mechanical alloying is characterized in that fine $Y_2O_3$ particles are uniformly dispersed in the matrix which are stable at high temperatures results in enhanced high-temperature strength and a reduction of the shearing strain of the fraction during high strain rate deformation.

4 Claims, 5 Drawing Sheets

PROCESS FOR MAKING OXIDE DISPERSION-STRENGTHENED TUNGSTEN HEAVY ALLOY BY MECHANICAL ALLOYING

BACKGROUND OF THE INVENTION

1. Field of the Invention

The present invention relates to a process for making an oxide dispersion-strengthened tungsten heavy alloy mainly used for an amour-plate-destroying warhead by mechanical alloying.

2. Description of the Related Art

Tungsten heavy alloy is mainly comprised of 90 to 98 wt. % of tungsten to use the high-density property of the tungsten, and nickel and iron for the rest at a weight ratio of 7:3 to 8:2 to enhance the sintering property and processability. Such a tungsten heavy alloy has a fine structure in which body-centered cubic (BCC) spherical tungsten grains with a particle size of 30 to 40 mm are dispersed in the face-centered cubic (FCC) W—Ni—Fe matrix. The tungsten heavy alloy possesses excellent mechanical properties, for example, high density of 16 to 18.5 g/cm$^2$, high tensile strength of 800 to 1200 MPa and elongation percentage of 20 to 30% and is broadly used as a material for the balanced supports of aircrafts, radiation shielding devices, vibration attenuators, and the piercers of amour-plate-destroying kinetic energy piece. The conventional tungsten heavy alloy is manufactured by a powder metallurgy process that involves sintering mixed powders of tungsten, nickel and iron at a temperature above 1460° C.

The amour-plate-destroying piercers using a high kinetic energy to pierce the amour plate are made from depleted uranium or a tungsten heavy alloy that has high density, high strength and high impact energy. The amour-plate-destroying piercer made from depleted uranium is excellent in the piercing ability but currently limited in its use because it is disadvantageously poor in processability and abrasion resistance and, especially, incurs radioactive contamination. The amour-plate-destroying piercer made from a tungsten heavy alloy has a smaller piercing depth per density than the amour-plate-destroying piercer made from depleted uranium in piercing the amour plate. For that reason, many studied have been made on a material for the amour-plate-destroying piercer replacing the depleted uranium with improved mechanical properties of the tungsten heavy alloy.

The oxide dispersion strengthening method involves dispersion of a thermodynamically stable fine oxide in a metallic matrix without reaction with the base phase to fabricate a high-temperature material, which is advantageously excellent in high-temperature mechanical properties and usable at a high temperature approximately up to the melting point.

The known oxide dispersion-strengthened alloys are as follows. The first commercially available oxide dispersion-strengthened alloy was $ThO_2$ dispersion-strengthened tungsten (GE, U.S.A., 1910) and developed as TD-Nickel (Du Pont, U.S.A., 1962) containing 2 vol % of $ThO_2$ dispersed in the Ni matrix as a structural material. The earnest applications of the oxide dispersion-strengthened alloys started from the manufacture of $Y_2O_3$ dispersion-strengthened Ni-based superalloy using the mechanical alloying technique by Benjamin at Inco Co. (U.S.A) in 1970. The oxide dispersion-strengthening technique has been applied in the manufacture of dispersion-strengthened Cu alloy, dispersion-strengthened Al alloy and dispersion-strengthened W alloy as well as Ni-based superalloy, which are used as a material for aircraft engine, welding electrodes, electrical contact material, and so forth.

No document has been found that suggests the process for making an oxide dispersion-strengthened tungsten heavy alloy by mechanical alloying and the use of the oxide dispersion-strengthened tungsten heavy alloy for amour-plate-destroying piercers. Especially, it is preferable for the amour-plate-destroying piercers to be susceptible to local fracture with concentrated stress under the shearing strain around the oxide dispersed in the matrix in order to have an enhanced piercing performance, since the piercers need the self-sharpening effect by which the edge of the piercers is fractured to make the piercers sharpened. However, there is still no report on the systematic research on the process for making the oxide dispersion-strengthened tungsten heavy metal, in particular, enhancing the self-sharpening by the oxide dispersion.

Accordingly, the inventors have studied on the subject and found out that an oxide dispersion-strengthened tungsten heavy alloy containing a uniform $Y_2O_3$ dispersion in the tungsten heavy alloy can be manufactured from a composition including $Y_2O_3$ powders and tungsten heavy alloy powders by mechanical alloying and liquid-phase sintering.

SUMMARY OF THE INVENTION

It is, therefore, an object of the present invention to provide a process for making an oxide dispersion-strengthened tungsten heavy alloy with enhanced high-temperature compression strength and susceptible to fracture during shear deformation by dispersing an oxide in the matrix uniformly and minutely by a mechanical alloying.

To achieve the above object of the present invention, there is provided a process for making an oxide dispersion-strengthened tungsten heavy alloy by mechanical alloying, the process including the steps of: adding 0.1 to 5 wt. % of $Y_2O_3$ powders to mixed powders comprising more than 90 wt. % of tungsten powders, and nickel and iron powders for the rest; subjecting the resulting mixture to a mechanical alloying to prepare oxide dispersion-strengthened tungsten heavy alloy powders; compacting the tungsten heavy alloy powders into compressed powders using a press; and sintering the compressed powder at a temperature in the range of 1400 to 1600° C.

The oxide dispersion-strengthened tungsten heavy alloy prepared by the mechanical alloying is characterized in that the fine $Y_2O_3$ particles are uniformly dispersed in the matrix. The addition of the $Y_2O_3$ particles stable at high temperatures results in enhanced high-temperature strength and a reduction of the shearing strain of the fracture during high-speed shear deformation, based on which fact, a technique has been developed to control the mechanical properties of the oxide dispersion-strengthened tungsten heavy alloy by varying the added amount of the $Y_2O_3$.

The tungsten heavy alloy uses the high density (19.3 g/cm$^3$) of tungsten and its chief application, e.g., the amour-plate-destroying kinetic energy piercer has the piercing performance enhanced with an increase in the density. The depleted uranium alloy used for the kinetic energy piercer has a high density, for example, 17.2 g/cm$^3$ for DU-8Mo and 17.3 g/cm$^3$ for DU-6Nb. For that reason, the tungsten heavy alloy suitable for the kinetic energy piercer must have a high density of more than 17 g/cm$^3$ so that it has to contain more than 90 wt. % of tungsten.

The conventional ball milling method using low energy simply mixes the powders without a reduction of the grain size or the lamella distance. The most important thing in the process for making the oxide dispersion-strengthened tungsten heavy alloy is uniformly dispersing the fine oxide particles in the matrix. Thus the present invention utilizes the mechanical alloying method to obtain tungsten heavy alloy powders having a reduced grain size of less than 100 nm and a reduced lamella distance of less than 0.5 $\mu$m.

The added amount of the $Y_2O_3$ is preferably in the range from 0.1 to 5 wt. % based on the total weight of the tungsten heavy alloy. The amount of the $Y_2O_3$ less than 0.1 wt. % hardly contributes to the reduction of the tungsten grain size or an increase in the high-temperature mechanical properties, whereas the amount of the $Y_2O_3$ more than 5 wt. % rather results in a deterioration of the mechanical properties and mechanical processability.

The tungsten alloy powders obtained by the mechanical alloying method of the present invention are then compacted under a pressure into compressed powders and then subjected to a sintering in the temperature range of 1400 to 1600° C. The sintering temperature below 1400° C. hardly achieves sufficient sintering and reduces the relative density of the final product with a deterioration of the mechanical properties, whereas the sintering temperature above 1600° C. excessively increases the liquid phase fraction and the diffusion velocity to result in a rapid growth of the tungsten grains with a deterioration of the mechanical properties.

The sintering step is preferably performed under the reducing atmosphere, for example, hydrogen atmosphere in order to reduce the oxide that is contained in the metal powders and inhibits the densification. As such, a second heat treatment is preferably performed under the nitrogen atmosphere so as to remove the residual hydrogen.

DETAILED DESCRIPTION OF THE PREFERRED EMBODIMENT

Hereinafter, the present invention will be described in further detail with reference to the following example.

EXAMPLE 0.1 to 5 wt. % of $Y_2O_3$ powders were added to a tungsten heavy alloy comprising 93 wt. % of W, 5.6 wt% of Ni and 1.4 wt. % of Fe and the mixture was uniformly mixed by a mechanical alloying method. The W powders had a purity of 99.9% and a particle size of 2.5 mm, the Ni powders having a purity of 99.7% and a particle size of 2.5 mm, the Fe powders having a purity of 99.6% and a particle size of 3.5 mm, the $Y_2O_3$ powders having a purity of 99.9% and a particle size of 2 mm. The mechanical alloying method using ball milling was carried out under the conditions that the milling speed was 75 rpm, the ball-to-powder ratio 20:1, the ball packing percentage 15% and the milling time 72 hours.

The oxide dispersion-strengthened tungsten heavy alloy thus obtained by the mechanical alloying was compacted into compressed powders under the pressure of 100 MPa using a press. The compacted compressed powders were then sintered under the hydrogen atmosphere at 1485° C. for one hour. To remove the tungsten heavy alloy of the residual hydrogen that deteriorates the mechanical properties, the sintered powders were subjected to a heat treatment under the nitrogen atmosphere at 1150° C. for one hour and then cooled in water.

Figure 1:
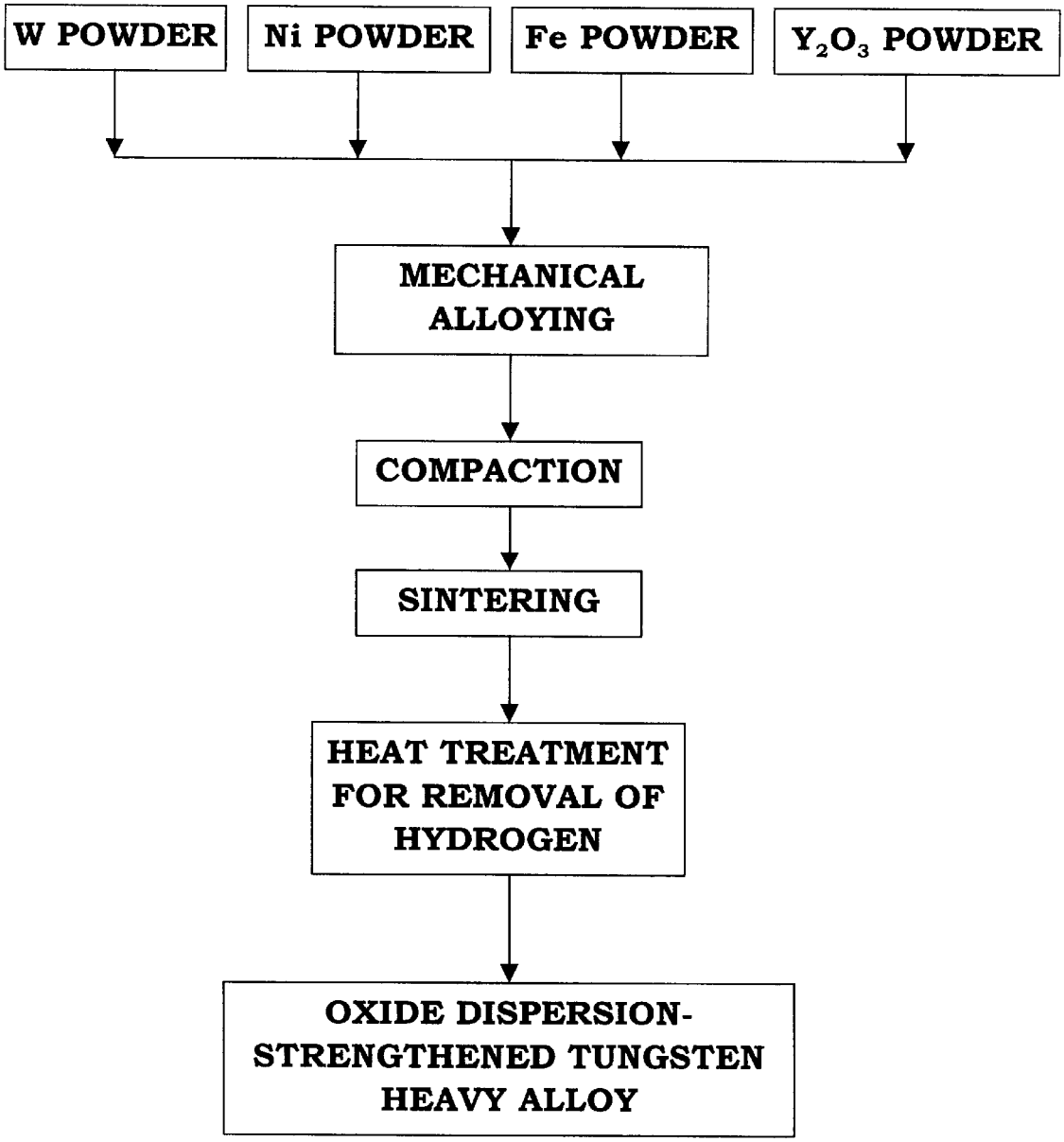
FIG. 1 is a diagram showing a process for making the oxide dispersion-strengthened tungsten heavy alloy in accordance with the present invention.

FIG. 1 is a diagram showing a process for making the oxide dispersion-strengthened tungsten heavy alloy in accordance with the present invention.

Figure 2:
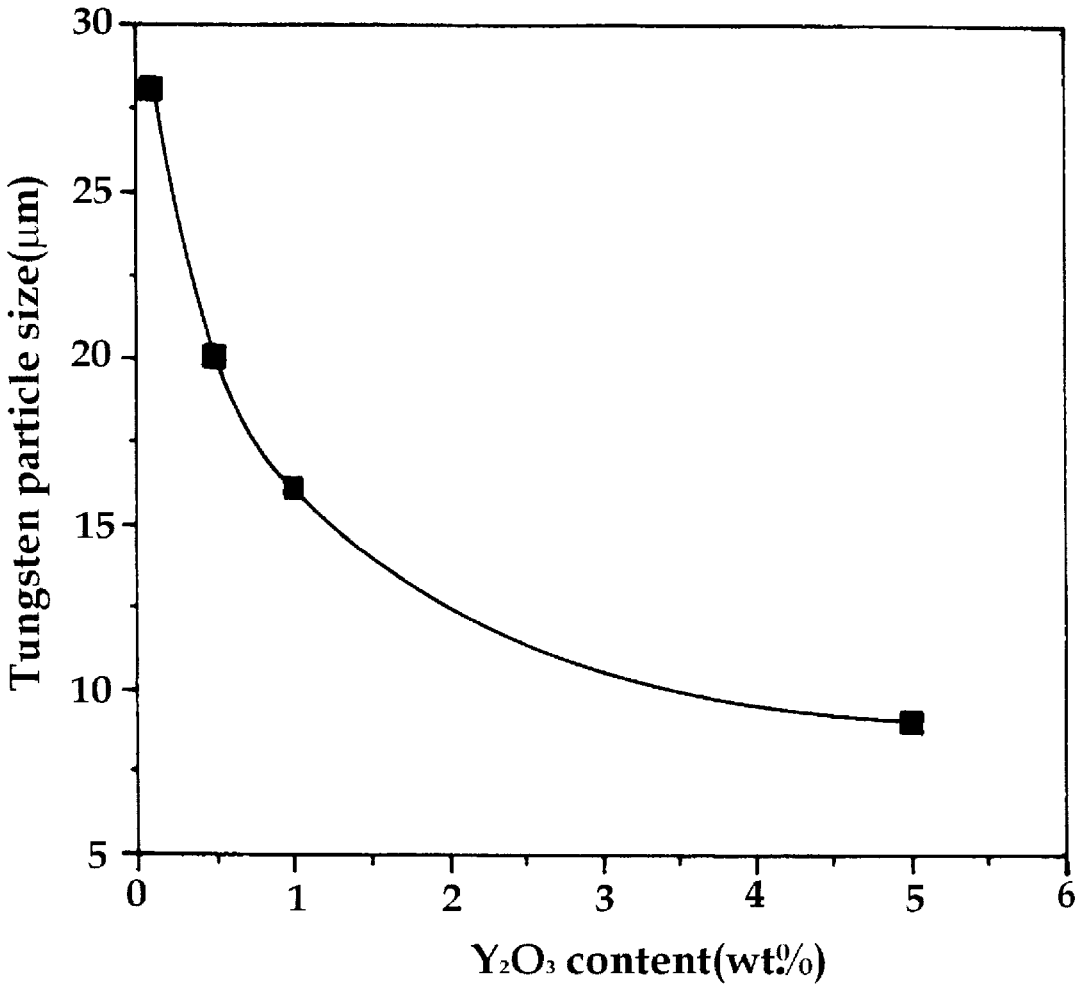
FIG. 2 shows the variations of the particle size of tungsten grains based on the $Y_2O_3$ content after sintered at 1485° C. for one hour.

An observation of the fine structure of the tungsten heavy alloy thus obtained shows that $Y_2O_3$ almost appears in the interface between the tungsten and the matrix and not in the tungsten grains. The oxide, i.e., $Y_2O_3$ existing in the interface between the tungsten and the matrix inhibits the growth of the tungsten grains. When the tungsten grains were sintered with varying the amount of the oxide, the tungsten grain size was decreased from 30 mm to 10 mm with an increase in the amount of the $Y_2O_3$ from 0.1 wt. % to 5.0 wt. %, as shown in FIG. 2. This demonstrates that the addition of the oxide is effective in the refinement of the tungsten grains.

Meanwhile, a high-temperature compression test was carried out at a testing temperature of 800° C. with a hot working simulator (Thermecmaster) that realized the strain rate of $10^1$/s in order to examine the high-temperature compacting property of the oxide dispersion-strengthened tungsten heavy alloy of the present invention. The results are presented in FIG. 3.

Figure 3:
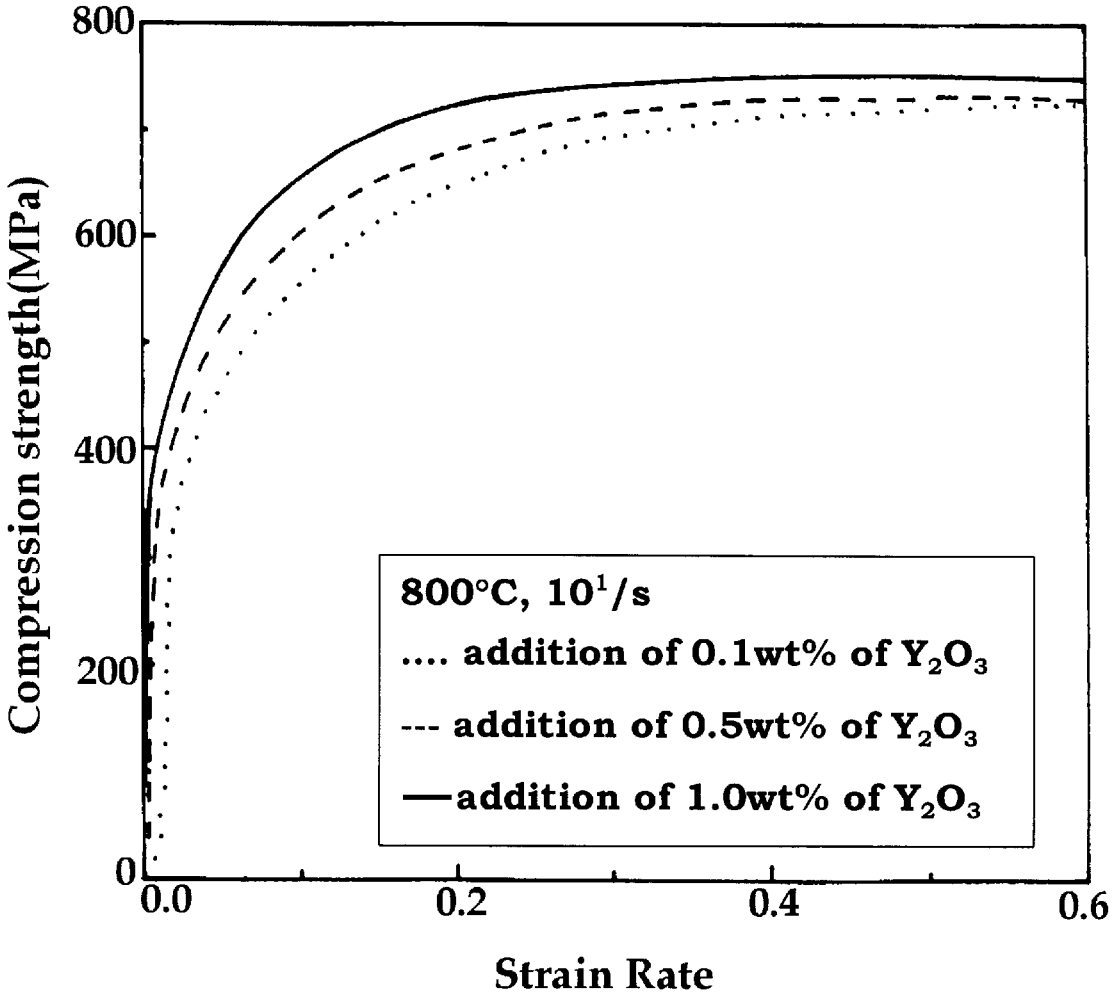
FIG. 3 is a curve showing the compression strength of the oxide dispersion-strengthened tungsten heavy alloy of the present invention subjected to high-temperature compression at 800° C.

As shown in FIG. 3, the oxide dispersion-strengthened tungsten heavy alloy had a high-temperature compression strength gradually increased with an increase in the added amount of the $Y_2O_3$ from 0.1 wt. % to 1.0 wt. %. This means that the dispersion strengthening of the oxide stable at high temperatures inhibits the deformation of the tungsten heavy alloy and that the addition of the oxide effectively enhances the high-temperature compression strength.

Figure 4:
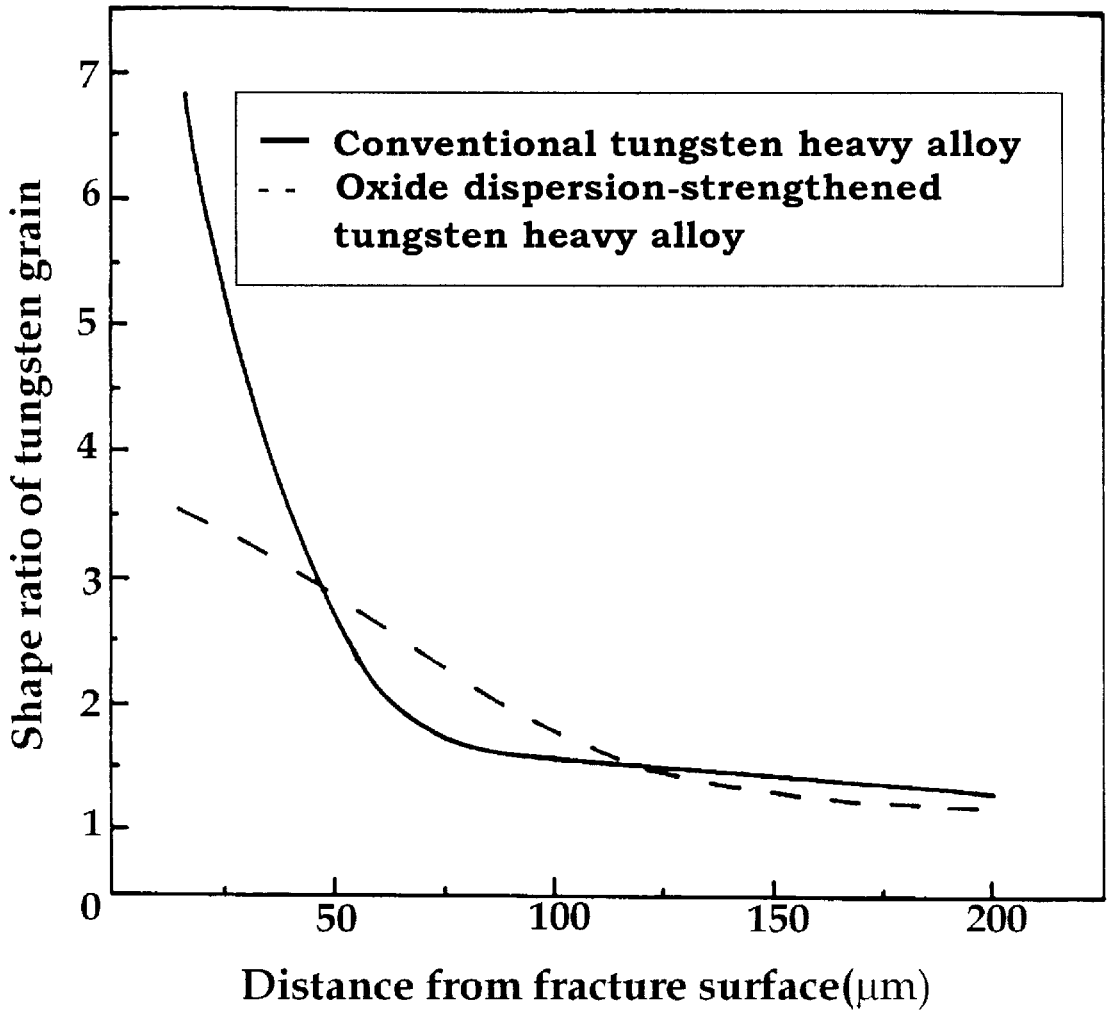
FIG. 4 shows the variations of the shape ratio of tungsten grains based on the distance from the fracture surface after a shearing test that involves high-speed compression of the conventional tungsten heavy alloy and the oxide dispersion-strengthened tungsten heavy alloy of the present invention.

FIG. 4 shows the variations of the shape ratio of the tungsten grains based on the distance from the fracture surface after a shearing test that involves high-speed compression of the conventional tungsten heavy alloy and the oxide dispersion-strengthened tungsten heavy alloy of the present invention. As is apparent from FIG. 4, a Hopkinson bar test was carried out on the samples designed to have the same shearing strain to examine the change of the sharing strain of the samples fractured at a strain rate of $10^4$/s. As the distance from the fracture surface decreased, the conventional tungsten heavy alloy had a sharp increase in the shape ratio of the tungsten grains, whereas the oxide dispersion-strengthened tungsten heavy alloy of the present invention showed a gradual increase in the shape ratio of the tungsten grains. This implies that the oxide dispersion-strengthened tungsten heavy alloy is susceptible to local fracture under the shearing strain.

On the other hand, a 7 mm-diameter kinetic energy piercer composed of the tungsten heavy alloy was subjected to a piercing test and the residual piercer was obtained. As a result, the oxide dispersion-strengthened tungsten heavy alloy was more susceptible to fracture at the edge portions under the shearing strain than the conventional tungsten heavy alloy and showed self-sharpening. According to the results of the experiments carried out by the inventors, after the piercing test, the conventional tungsten heavy alloy had a diameter of 11.8 mm with a diameter increment of 69% and the oxide dispersion-strengthened tungsten heavy alloy had a diameter of 8.8 mm with a diameter increment of no more than 25%.

Figure 5:
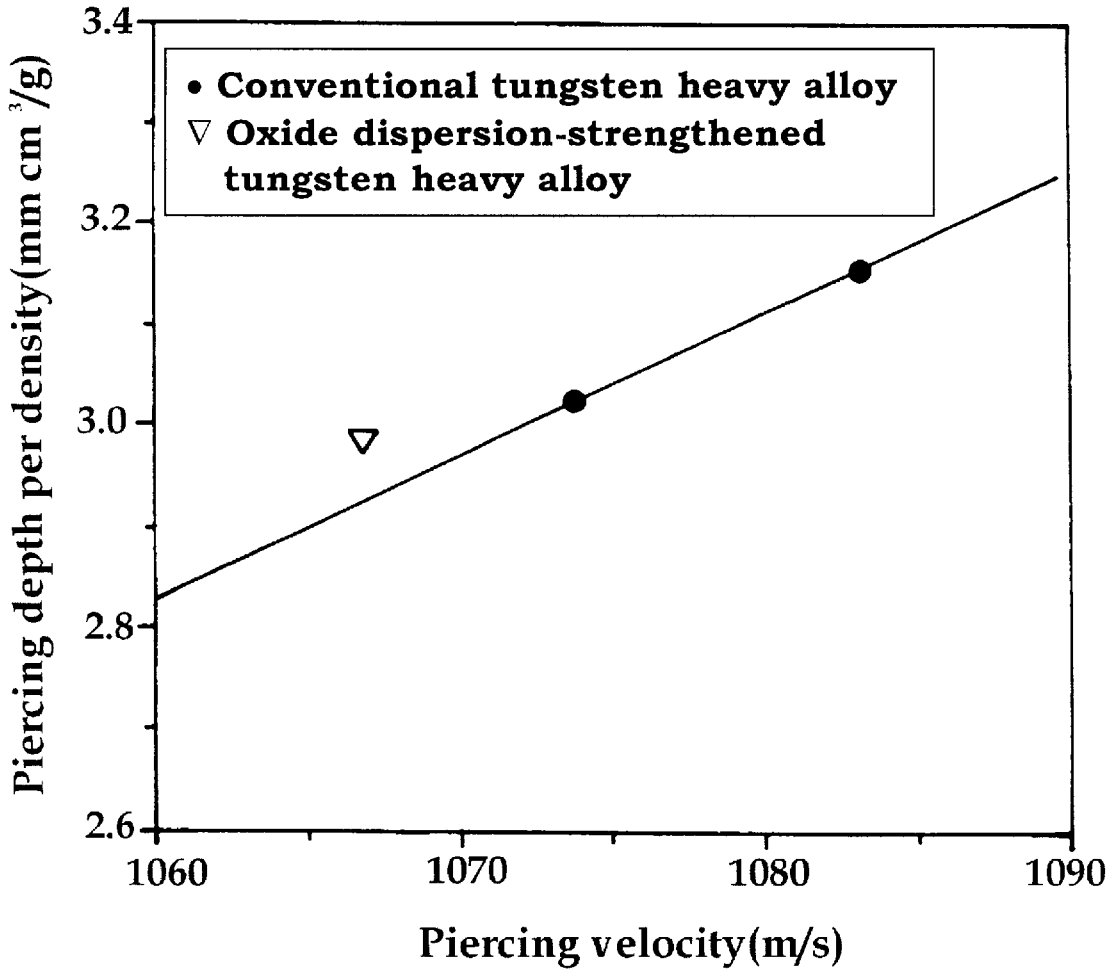
FIG. 5 shows the piercing depth per density of a kinetic energy piercer made from the conventional tungsten heavy alloy and one made from the oxide dispersion-strengthened tungsten heavy alloy of the present invention.

FIG. 5 shows the piercing depth per density of the conventional tungsten heavy alloy and the oxide dispersion-strengthened tungsten heavy alloy of the present invention, in which the latter has a larger piercing depth per density than the former. This presumably results from the self-sharpening effect of the oxide dispersion-strengthened tungsten heavy alloy, which is caused by the increased high-temperature compression strength and the reduced elongation percentage.

Compared to the conventional tungsten heavy alloy, the oxide dispersion-strengthened tungsten heavy alloy manufacture according to the present invention maintains refinement of the tungsten grains with enhanced high-temperature compression strength and readily fractures under shearing strain to have the self-sharpening effect necessary to an excellent piercing property. Due to these features, the oxide dispersion-strengthened tungsten heavy alloy of the present invention is useful as a material for kinetic energy piercers.

It is to be noted that like reference numerals denote the same components in the drawings, and a detailed description of generally known function and structure of the present invention will be avoided lest it should obscure the subject matter of the present invention.

What is claimed is:

1. A process for making an oxide dispersion-strengthened tungsten heavy alloy by mechanical alloying for an armor plate destroying warhead having self-sharpening susceptibility during high strain rate deformation, comprising the steps of:

adding 0.1 to 5 wt. % of $Y_2O_3$ powders to mixed powders comprising more than 90 wt. % of tungsten powders, and nickel and iron powders for the rest;

subjecting the resulting mixture to a mechanical alloying to prepare oxide dispersion-strengthened tungsten heavy alloy powders having a tungsten grain size of less than 100 nm and a lamella distance less than 0.5 $\mu$m;

compacting the tungsten heavy alloy powders into compressed powders using a press; and sintering the compressed powders at a temperature in the range of 1400 to 1600° C.

2. The process as claimed in claim 1, wherein the sintering step of the compressed powders are performed under the hydrogen atmosphere.

3. The process as claimed in claim 2, further comprising the step of subjecting the sintered alloy to a heat treatment under the nitrogen atmosphere to remove residual hydrogen.

4. An oxide dispersion-strengthened tungsten heavy alloy prepared according to claim 1.

* * * * *